US009842670B2

(12) United States Patent
Lee et al.

(10) Patent No.: US 9,842,670 B2
(45) Date of Patent: Dec. 12, 2017

(54) CABLE HAVING POLYMER WITH ADDITIVE FOR INCREASED LINEAR PULLOUT RESISTANCE

(71) Applicant: Rockbestos Surprenant Cable Corp., East Granby, CT (US)

(72) Inventors: David Lee, Brampton (CA); Douglas Neil Burwell, Georgetown (CA)

(73) Assignee: Rockbestos Surprenant Cable Corp., East Granby, CT (US)

( * ) Notice: Subject to any disclaimer, the term of this patent is extended or adjusted under 35 U.S.C. 154(b) by 898 days.

(21) Appl. No.: 14/075,259

(22) Filed: Nov. 8, 2013

(65) Prior Publication Data

US 2015/0129241 A1 May 14, 2015

(51) Int. Cl.

| | |
|---|---|
| ***E21B 17/00*** | (2006.01) |
| ***H01B 19/04*** | (2006.01) |
| ***H01B 7/18*** | (2006.01) |
| ***H01B 7/20*** | (2006.01) |
| ***H01B 7/29*** | (2006.01) |
| ***E21B 17/20*** | (2006.01) |
| *H01B 3/30* | (2006.01) |
| *H01B 7/04* | (2006.01) |

(52) U.S. Cl.

CPC ..... *H01B 7/189* (2013.01); *E21B 17/20* (2013.01); *H01B 7/20* (2013.01); *H01B 7/29* (2013.01); *H01B 19/04* (2013.01); *H01B 3/30* (2013.01); *H01B 7/046* (2013.01)

(58) Field of Classification Search

CPC . H01B 19/04; H01B 3/30; H01B 7/29; H01B 7/17; E21B 17/00; E21B 17/206

See application file for complete search history.

(56) References Cited

U.S. PATENT DOCUMENTS

| | | | | |
|---|---|---|---|---|
| 4,764,538 | A * | 8/1988 | Buckmaster | C08J 9/0066 521/145 |
| 5,750,931 | A | 5/1998 | McGregor et al. | |
| 5,770,819 | A * | 6/1998 | Mehan | C08L 23/08 174/110 F |
| 5,894,104 | A * | 4/1999 | Hedberg | H01B 7/046 174/36 |
| 6,198,865 | B1 | 3/2001 | Risch | |
| 6,389,204 | B1 | 5/2002 | Hurley | |
| 7,747,117 | B2 | 6/2010 | Greenwood et al. | |
| 8,023,789 | B2 | 9/2011 | Aoyagi et al. | |
| 8,285,096 | B2 | 10/2012 | Coleman et al. | |
| 8,303,193 | B2 | 11/2012 | Coleman et al. | |
| 2006/0165355 | A1 | 7/2006 | Greenwood et al. | |
| 2006/0254792 | A1* | 11/2006 | Kimura | H01B 11/1834 174/28 |
| 2009/0046983 | A1* | 2/2009 | Varkey | G02B 6/443 385/113 |

(Continued)

*Primary Examiner* — Daniel P Stephenson

(74) *Attorney, Agent, or Firm* — Hayes Soloway PC

(57) ABSTRACT

A cable apparatus having an increased linear pullout resistance and related methods is disclosed. The apparatus includes a metal tube. At least one conductor is positioned within the metal tube. An armor shell is positioned exterior of the metal tube and the at least one conductor. A polymer material is abutting the metal tube, wherein the polymer material includes therein at least one additive, wherein the polymer material with the at least one additive remains substantially inert during a recrystallization process.

15 Claims, 3 Drawing Sheets

(56) References Cited

U.S. PATENT DOCUMENTS

| | | | | |
|---|---|---|---|---|
| 2009/0145610 | A1* | 6/2009 | Varkey | E21B 17/206 166/335 |
| 2009/0200059 | A1 | 8/2009 | Cinquemani et al. | |
| 2009/0279837 | A1 | 11/2009 | Aoyagi et al. | |
| 2010/0080516 | A1 | 4/2010 | Coleman et al. | |
| 2010/0080525 | A1 | 4/2010 | Colman et al. | |
| 2011/0024103 | A1* | 2/2011 | Storm, Jr. | E21B 17/206 166/65.1 |
| 2011/0091172 | A1 | 4/2011 | Coleman et al. | |
| 2011/0176814 | A1 | 7/2011 | Tsukamoto et al. | |
| 2011/0232936 | A1* | 9/2011 | Magner | H01B 3/445 174/102 C |
| 2012/0006444 | A1* | 1/2012 | Tupper | E21B 17/20 138/149 |
| 2014/0069686 | A1* | 3/2014 | Abe | H01B 7/02 174/110 SR |
| 2014/0110146 | A1* | 4/2014 | Magner | H01B 13/22 174/102 R |
| 2014/0138117 | A1* | 5/2014 | Iwasaki | H01B 3/441 174/110 SR |
| 2014/0190706 | A1* | 7/2014 | Varkey | F04B 47/06 166/378 |
| 2015/0129241 | A1* | 5/2015 | Lee | H01B 7/29 166/385 |
| 2015/0170799 | A1* | 6/2015 | Varkey | G02B 6/4416 174/70 R |
| 2016/0259143 | A1* | 9/2016 | Vintermyr | E21B 17/00 |
| 2016/0265339 | A1* | 9/2016 | Xia | H01B 7/046 |
| 2016/0281494 | A1* | 9/2016 | Shirdel | E21B 43/24 |
| 2017/0263351 | A1* | 9/2017 | Magner | H01B 3/445 |

* cited by examiner

CABLE HAVING POLYMER WITH ADDITIVE FOR INCREASED LINEAR PULLOUT RESISTANCE

FIELD OF THE DISCLOSURE

The present disclosure is generally related to cables and more particularly is related to cables having a polymer with an additive for increased linear pullout resistance.

BACKGROUND OF THE DISCLOSURE

Elongated cables are found in use in many industries including those that conduct deep drilling, such as within the oil drilling industry. These cables may be used to transmit information and data from a drilling region having the drilling equipment to a control center located remote to the drilling region. Many oil drilling regions are located deep within the Earth's crust, such as those seen with onshore and offshore drilling. The drilling region may be 5,000 feet or more from a control center located on the Earth's surface or a control center located on water at sea level. A cable of 5,000 feet or more may have a high weight that, when located vertically down a drilling hole distorts the structure of the cable itself. This may result in a failure of the cable or a deformity of the cable that renders it more inefficient than a non-deformed cable.

It is common for cables used in industries today to be subjected to high-temperature applications, as well as potential damaging situations. For example, cables may be subject to high temperatures from oil drilling operations, equipment, or other devices that may create heat. A metal casing is often used around the cable to help prevent transfer of the heat into the inner components of the cable. This metal casing, for example, may seal off any gassing of the inner materials of the cable, as well as prevent rocks, sharp objects, or other potentially damaging items from causing harm to the cable. When subjected to heat, many materials will deform or give off volatiles that will lower the insulation resistance of the insulating materials, especially when temperatures exceed 250° C. Materials such as perfluoroalkoxy (PFA) may be used up to temperatures of approximately 250° C., but may be unsuccessful in higher temperature.

Sensor cables may be used with polymers in, under, and over a metal tube. The polymer inside the tube is an electrical insulator, but also must hold to the tube with sufficient force to transfer forces from the conductor to the tube so the conductor does not break under its own weight. When thermoplastic polymers are used under tube and a jacket is placed over the tube it was found that the pullout strength of the core decreased. This was not initially noted under non-operational conditions, but when the cable, with or without a jacket, was subjected to high temperatures or other operational conditions, the decreased pullout strength of the core was apparent.

Thus, a heretofore unaddressed need exists in the industry to address the aforementioned deficiencies and inadequacies.

SUMMARY OF THE DISCLOSURE

Embodiments of the present disclosure provide a cable apparatus. Briefly described, in architecture, one embodiment of the system, among others, can be implemented as follows. The cable apparatus includes a metal tube. At least one conductor is positioned within the metal tube. An armor shell is positioned exterior of the metal tube and the at least one conductor. A polymer material is abutting the metal tube, wherein the polymer material includes therein at least one additive, wherein the polymer material with the at least one additive remains substantially inert during a recrystallization process.

The present disclosure can also be viewed as providing a method of using a down-hole cable apparatus. In this regard, one embodiment of such a method, among others, can be broadly summarized by the following steps: placing the down-hole cable apparatus in an operational position, wherein the down-hole cable apparatus comprises a metal tube, at least one conductor positioned within the metal tube, an armor shell positioned exterior of the metal tube and the at least one conductor, and a polymer material abutting the metal tube, wherein the polymer material includes therein at least one additive, wherein the polymer material with the at least one additive remains substantially inert during a recrystallization process; and subjecting the down-hole cable apparatus to an operational catalyst, wherein while the down-hole cable apparatus is subjected to the operational catalyst, the polymer material having the at least one additive remains substantially inert, thereby preventing linear separation of at least one of the at least one conductor and the armor shell from the metal.

The present disclosure can also be viewed as providing a method of manufacturing a cable apparatus having an increased linear pullout resistance. In this regard, one embodiment of such a method, among others, can be broadly summarized by the following steps: positioning at least one conductor within a metal tube; affixing an armor shell exterior of the metal tube and the at least one conductor; applying a polymer material having at least one additive therein interior of the armor shell and in abutment to the metal tube, wherein the polymer material having the at least one additive remains substantially inert during a recrystallization process.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
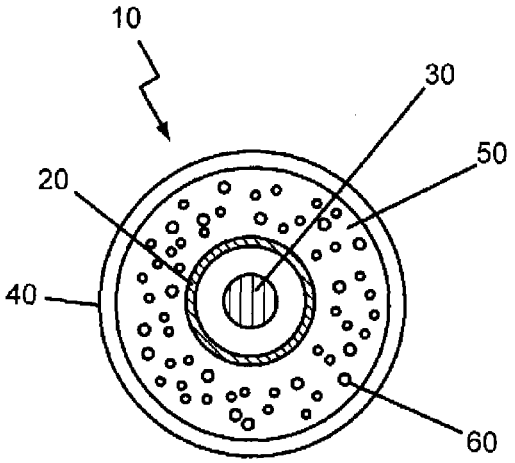
FIG. 1 is a cross-sectional illustration of a cable apparatus, in accordance with a first exemplary embodiment of the present disclosure.

FIG. 1 is a cross-sectional illustration of a cable apparatus 10, in accordance with a first exemplary embodiment of the present disclosure. The cable apparatus 10, which may be referred to herein as 'apparatus 10' includes a metal tube 20. At least one conductor 30 is positioned within the metal tube 20. An armor shell 40 is positioned exterior of the metal tube 20 and the at least one conductor 30. A polymer material 50 is abutting the metal tube 20, wherein the polymer material 50 includes therein at least one additive 60, wherein the polymer material 50 with the at least one additive 60 remains substantially inert during a recrystallization process.

The cable apparatus 10 may be any wire, transmission line or similar structure, including those used in deep drilling operations, such as with onshore or offshore oil drilling. The at least one conductor 30 may include any material, which is capable of facilitating movement of electric charges, light or any other communication medium. The conductor 30 may include conductor materials such as copper, aluminum, alloys, fiber electric hybrid materials, fiber optical material or any other material known within the industry. The conductor 30 may be capable of facilitating movement of energy capable of powering a device or facilitating a communication or control signal between devices. The conductor 30 may be located at substantially the center of the cable apparatus 10, but may also be located off-center or in another position as well. It is noted that the cable apparatus 10, as well as the cables described relative to the other embodiments of this disclosure, may include a plurality (not shown) of conductors 30, such as two or more solid conductor materials, or many conductors 30 formed from varying conducting materials. The plurality of the conductors 30 may facilitate the transmission of electrical energy through the cable apparatus 10, or may facilitate communication of control signals through the cable apparatus 10. Any number conductors 30 may be included with the cable apparatus 10, configured in any orientation or fashion, such as conductors 30 bound together or woven together.

The metal tube 20 may be constructed from a variety of metals and metal compounds and be sized to receive the conductor 30. The metal tube 20 may include a rigid or non-rigid metal tubing structure, such as one constructed from woven metal filaments. The armor shell 40 is a sheath or exterior coating or layer that protects the inner components of the cable 10. Any material, substance or layer located on the exterior of the cable 10 and capable of protecting the cable 10 may be considered an armor shell 40. The armor shell 40 may be substantially concentric to the at least one conductor 20 and constructed from a strong material, such as a stainless steel or Incoloy. The armor shell 40 may protect the cable 10 from foreign objects penetrating the cable 10, such as debris from a drilling process. The armor shell 40 may also include any woven, solid, particulate-based and layered protecting materials.

The polymer material 50 is abutting the metal tube 20, interior of the metal tube 20 and proximate to the conductor 30, exterior to the metal tube 20, or on both the exterior and the interior surfaces of the metal tube 20. For example, as is shown in FIG. 1, the polymer material 50 may be positioned exterior of the metal tube 20 and in contact with the armor shell 40, such that the polymer material 50 contacts both the metal tube 20 and the armor shell 40. Other layers of the cable apparatus 10, such as insulation layers, strength materials, sacrificial materials, or protection materials, while not shown in FIG. 1, may also be included with the cable apparatus 10. The polymer material 50 may be positioned abutting or surrounding any of these materials or structures. The polymer material 50 may act as an insulating layer or electrical insulator but may also act as a structural member within the cable apparatus 10.

The polymer material 50 includes therein at least one additive 60, wherein the polymer material 50 with the at least one additive 60 remains substantially inert during a recrystallization process. The additive 60 may be at one or any combination of fillers such as talc, glass beads, nano clay, barium sulphate, calcium carbonate, and silicate. Other fillers may include ATH, magnesium oxide, clays, titanium dioxide, antimony oxide, mica, and/or carbon black. The additive 60 may be combined with the polymer material 50 in various quantities, including where the additive 60 is approximately 4% to 80% of the polymer material 50, or ideally where the additive 60 is approximately 10% to 30% of the polymer material 50. The additive 60 may be a non-expandable additive such that it does not increase in size after being combined with the polymer material 50 and/or after being positioned within the cable apparatus 10. Some other additives 60 not specifically mentioned herein may also be used, so long as the additive 60 is inert, mixes and disperses in the polymer material 50 (polymer matrix), and does not otherwise negatively affect physical properties of the polymer material 50. It is also desired for the additive 60 to not decompose or otherwise react under the physical stresses manufacturing and using the cable apparatus 10.

The combination of the polymer material 50 with the additive 60 may prevent linear pullout malfunctions of the components of the cable apparatus 10, since the polymer material 50 and additive 60 may increase the pullout resistance between the components in the cable apparatus 10. The failure of conventional cables is particularly prone when the conventional cable is subjected to high temperatures, high pressures, or other operational catalysts. The polymer material 50 with the additive 60 allow the cable apparatus 10 to resist pullout forces even when the cable apparatus 10 is objected to operational catalysts. The additive 60 combined with the polymer material 50 may remain unchanged or inert during processing and subsequent downstream operations where the cable apparatus 10 subjected to operational catalysts, in that the additive 60 helps prevent the polymer material 50 from decomposing or react under processing heats and pressures, especially when the cable apparatus 10 is subjected to cycles of temperature changes or pressure changes.

The polymer material 50 with the additive 60 may exhibits much lower dimensional variation as compared to conventional polymers used in conventional cables. For example, the combined polymer material 50 with the at least one additive 60 may have an operational dimension, which can be measured or otherwise determined. For instance, the operational dimension may be a measurement of the polymer material 50 with the additive 60 from its exterior surface to its interior surface. This operational dimension may be constant or substantially constant while the cable apparatus 10 is not subjected to operational catalysts. When the cable apparatus 10 is subjected to an operational catalyst, the additive 60 may keep the operational dimension of the polymer material 50 substantially equivalent to the operational dimension when not subjected to the operational catalysts. Thus, the dimensional variation of the polymer material 50 with the additive 60 is substantially lower than dimensional variations of polymer layers within conventional cables that are subjected to heat and pressures.

As another means of gauging the effectiveness of the polymer material 50 and the additive 60, a pullout resistance factor may be determined for the polymer material 50 with at least one additive 60. The pullout resistance factor may be an indication of the quantity of force applied on a component of the cable apparatus 10, e.g., the metal tube 20, such that it will not move linearly relative to other components of the cable apparatus 10, e.g., the armor shell 40. The pullout resistance factor of the cable apparatus 10 may remain substantially unchanged when the polymer material 50 with at least one additive 60 is subjected to an operational catalyst. While this disclosure uses operational catalysts of temperature increases and pressure increases as examples, it is noted that other operational catalysts are considered within the scope of this disclosure.

In operation, the cable apparatus 10 may be placed vertically, wherein one end of the cable apparatus 10 is substantially above the other end of the cable apparatus 10. This may include a cable apparatus 10 with any length, such as 100 feet, 300 feet, 500 feet or greater or any other length. For example, the cable apparatus 10 may be suspended within a hole drilled within the Earth's crust, wherein one end of the cable 10 is located above the Earth's crust and the other end is located 500 feet or more below the Earth's crust. The cable apparatus 10 may be held in this position for any period of time. The cable apparatus 10 may be used is locations proximate to high temperatures and/or high pressures, or other operational catalysts. For example, friction from a drilling operation may create a substantial amount of heat that may be transferred through the environment, e.g., water or air, to the cable apparatus 10. While being subjected to the operational catalysts and after the operational catalysts have ceased, the polymer material 50 with additive 60 may substantially prevent linear pullout malfunctions of the cable apparatus 10. As one having ordinary skill in the art would recognize, many variations, configuration and designs may be included with the cable 10, or any component thereof, all of which are considered within the scope of the disclosure.

Figure 2:
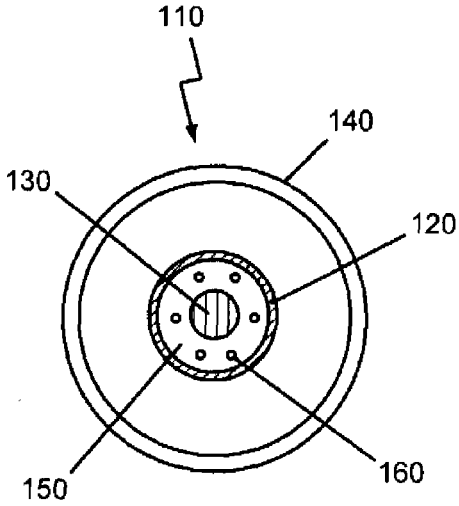
FIG. 2 is a cross-sectional illustration of a cable apparatus, in accordance with a second exemplary embodiment of the present disclosure.

FIG. 2 is a cross-sectional illustration of a cable apparatus 110, in accordance with a second exemplary embodiment of the present disclosure. The cable apparatus 110, which may be referred to simply as 'apparatus 110,' is substantially similar to the cables described in the other embodiments of this disclosure, and may include any of the features discussed relative to those embodiments. The apparatus 110 includes a metal tube 120. At least one conductor 130 is positioned within the metal tube 120. An armor shell 140 is positioned exterior of the metal tube 120 and the at least one conductor 130. A polymer material 150 is abutting the metal tube 120, wherein the polymer material 150 includes therein at least one additive 160, wherein the polymer material 150 with the at least one additive 160 remains substantially inert during a recrystallization process.

As is shown in FIG. 1, the polymer material 50 with additive 60 is positioned exterior of the metal tube 20 and in contact with the armor shell 40, such that the polymer material 50 contacts both the metal tube 20 and the armor shell 40. In FIG. 2, the polymer material 150 with additive 160 is positioned interior of the metal tube 120 such that it contacts the interior surface of the metal tube 120 and the conductor 130. The polymer material 150 with additive 160 positioned interior of the metal tube 120 may function as described relative to FIG. 1.

Figure 3:
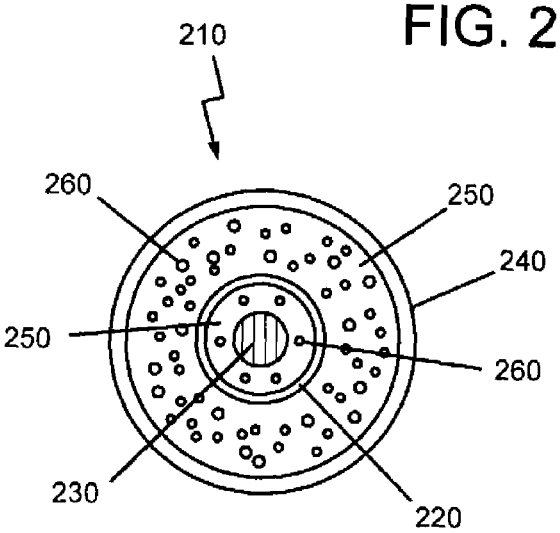
FIG. 3 is a cross-sectional illustration of a cable apparatus, in accordance with a second exemplary embodiment of the present disclosure.

FIG. 3 is a cross-sectional illustration of a cable apparatus 210, in accordance with a second exemplary embodiment of the present disclosure. The cable apparatus 210, which may be referred to simply as 'apparatus 210,' is substantially similar to the cables described in the other embodiments of this disclosure, and may include any of the features discussed relative to those embodiments. The apparatus 210 includes a metal tube 220. At least one conductor 230 is positioned within the metal tube 220. An armor shell 240 is positioned exterior of the metal tube 220 and the at least one conductor 230. A polymer material 250 is abutting the metal tube 220, wherein the polymer material 250 includes therein at least one additive 260, wherein the polymer material 250 with the at least one additive 260 remains substantially inert during a recrystallization process.

Figure 4:
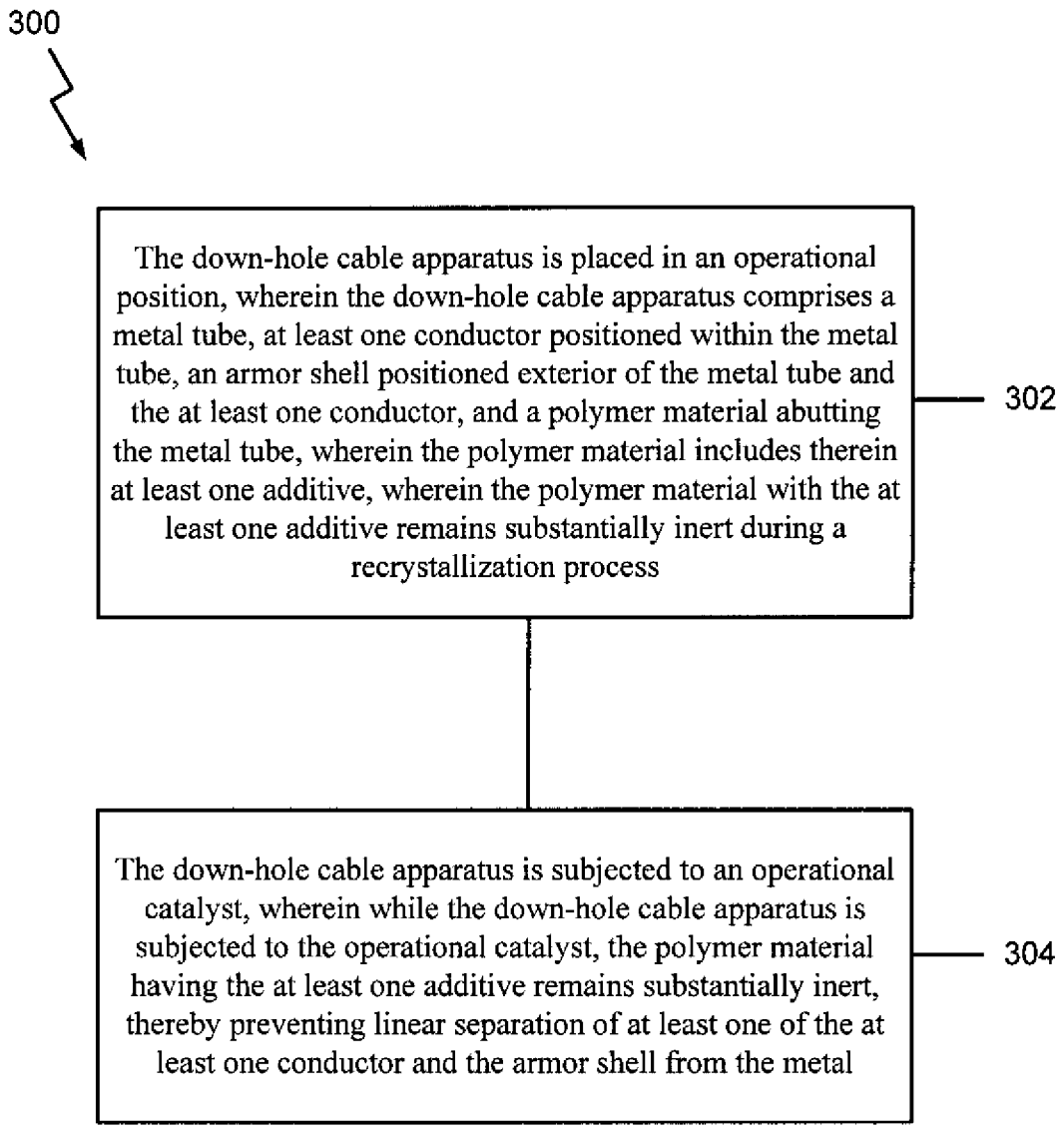
FIG. 4 is a flowchart illustrating a method of using a down-hole cable apparatus, in accordance with a fourth exemplary embodiment of the disclosure.

The cable apparatus 210 of FIG. 3 includes polymer material 250 with additive 260 positioned abutting both the interior and exterior surfaces of the metal tube. Thus, the polymer material 250 with additive 260 may be in contact with the armor shell 240, such that the polymer material 250 contacts both the metal tube 220 and the armor shell 240. At the same time, the polymer material 250 with additive 260 is positioned interior of the metal tube 220 such that it contacts the interior surface of the metal tube 220 and the conductor 230. The polymer material 250 with additive 260 in both positions may function as described relative to FIG. 1, but may provide increased pullout resistance, due to the additional use of polymer material 250 and additive 260 throughout the cable apparatus 210, as compared to FIGS. 1-2, FIG. 4 is a flowchart 300 illustrating a method of using a down-hole cable apparatus, in accordance with a fourth exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 302, the down-hole cable apparatus is placed in an operational position, wherein the down-hole cable apparatus comprises a metal tube, at least one conductor positioned within the metal tube, an armor shell positioned exterior of the metal tube and the at least one conductor, and a polymer material abutting the metal tube, wherein the polymer material includes therein at least one additive, wherein the polymer material with the at least one additive remains substantially inert during a recrystallization process. The down-hole cable apparatus is subjected to an operational catalyst, wherein while the down-hole cable apparatus is subjected to the operational catalyst, the polymer material having the at least one additive remains substantially inert, thereby preventing linear separation of at least one of the at least one conductor and the armor shell from the metal (block 304).

The method may also include any number of additional steps, processes, or functions, including those described relative to FIGS. 1-3. The additive may include one or more of talc, glass beads, nano clay, barium sulphate, calcium carbonate, and silicate, and it may be used in a variety of ratios relative to the polymer material. The operational catalyst may include temperature increases, pressure increases, or other environmental conditions. Substantially immediately after the operational catalyst is removed from the down-hole cable apparatus, the polymer material having the at least one additive may remain substantially inert, thereby preventing linear separation of at least one of the at least one conductor and the armor shell from the metal.

Figure 5:
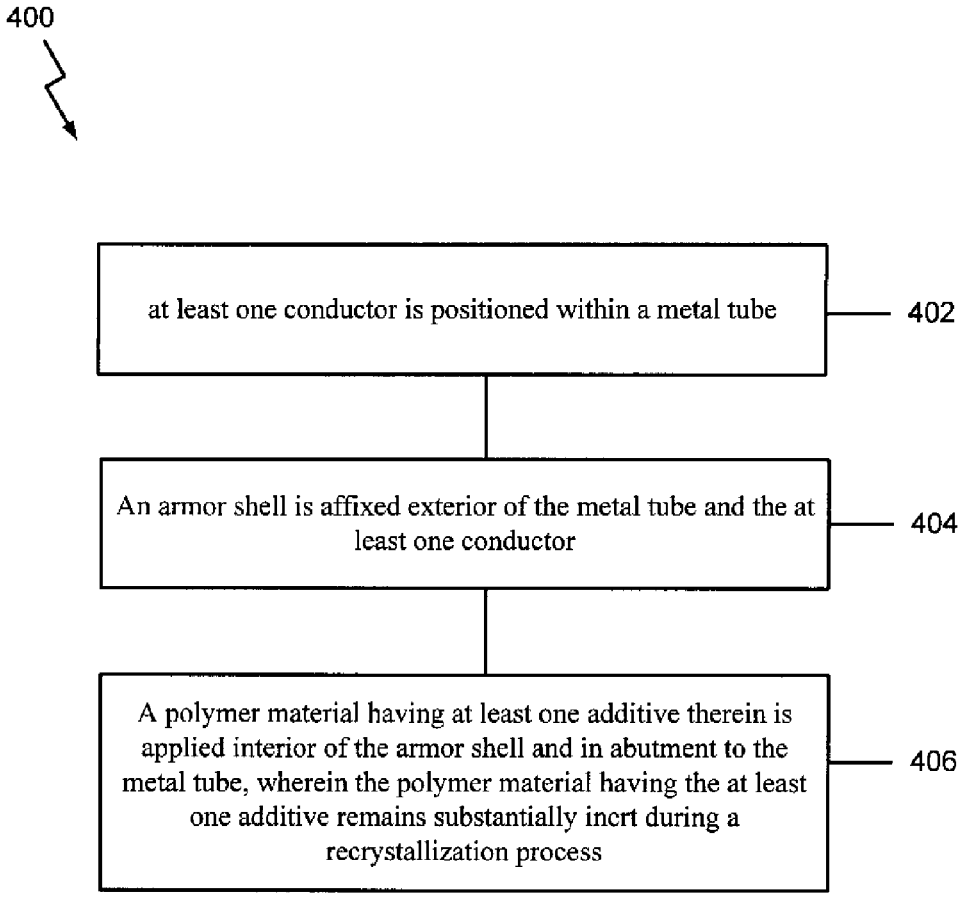
FIG. 5 is a flowchart illustrating a method of manufacturing a cable apparatus having an increased linear pull-out resistance, in accordance with a fifth exemplary embodiment of the disclosure.

FIG. 5 is a flowchart 400 illustrating a method of manufacturing a cable apparatus having an increased linear pull-out resistance, in accordance with a fifth exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 402, at least one conductor is positioned within a metal tube. An armor shell is affixed exterior of the metal tube and the at least one conductor (block 404). A polymer material having at least one additive therein is applied interior of the armor shell and in abutment to the metal tube, wherein the polymer material having the at least one additive remains substantially inert during a recrystallization process (block 406).

The method may also include any number of additional steps, processes, or functions, including those described relative to FIGS. 1-3. The additive may include one or more of talc, glass beads, nano clay, barium sulphate, calcium carbonate, and silicate, and it may be used in a variety of ratios relative to the polymer material. Additionally, a first pull-out resistance factor of the polymer material having the at least one additive may be identified during a non-operational state of the cable apparatus. The polymer material having the at least one additive may be subjected to an operational catalyst, wherein the operational catalyst includes at least one of: a temperature increase; and a pressure increase. A second pull-out resistance factor of the polymer material having the at least one additive may be identified when subjected to the operational catalyst, wherein the second pull-out resistance factor is substantially equivalent to the first pull-out resistance factor.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A cable apparatus comprising: a metal tube; at least one conductor positioned within the metal tube; an armor shell positioned exterior of the metal tube and the at least one conductor; and a polymer material abutting the metal tube, wherein the polymer material includes therein at least one additive, wherein the polymer material with the at least one additive remains substantially inert during a recrystallization process.

2. The cable apparatus of claim 1, wherein the polymer material is positioned between the metal tube and the at least one conductor.

3. The cable apparatus of claim 1, wherein the polymer material is positioned between the metal tube and the armor shell.

4. The cable apparatus of claim 1, wherein the polymer material is positioned between the metal tube and the at least one conductor and between the metal tube and the armor shell.

5. The cable apparatus of claim 1, wherein the at least one additive within the polymer material further comprises 10% to 30% of the polymer material.

6. The cable apparatus of claim 1, wherein the at least one additive within the polymer material further comprises 4% to 80% of the polymer material.

7. The cable apparatus of claim 1, wherein the at least one additive further comprises at least one of talc, glass beads, nano clay, barium sulphate, calcium carbonate, and silicate.

8. The cable apparatus of claim 1, wherein the at least one additive is a non-expandable additive.

9. The cable apparatus of claim 1, wherein polymer material with the at least one additive has an operational dimension, the operational dimension measured from an exterior surface of the polymer material with the at least one additive to an interior surface of the polymer material with the at least one additive, wherein the operational dimension is constant during operational use of the cable apparatus.

10. The cable apparatus of claim 1, wherein a pullout resistance factor of the polymer material with at least one additive remains substantially unchanged when the polymer material with at least one additive is subjected to an operational catalyst.

11. The cable apparatus of claim 10, wherein the operational catalyst further comprises at least one of: a temperature increase; and a pressure increase.

12. A method of manufacturing a cable apparatus having an increased linear pullout resistance, the method comprising the steps of: positioning at least one conductor within a metal tube; affixing an armor shell exterior of the metal tube and the at least one conductor; and applying a polymer material having at least one additive therein interior of the armor shell and in abutment to the metal tube, wherein the polymer material having the at least one additive remains substantially inert during a recrystallization process.

13. The method of claim 12, further comprising the step of mixing the at least one additive with the polymer material, wherein the at least one additive includes at least one of: talc, glass beads, nano clay, barium sulphate, calcium carbonate, and silicate.

14. The method of claim 12, wherein the at least one additive within the polymer material further comprises 4% to 80% of the polymer material.

15. The method of claim 12, further comprising the steps of: identifying a first pullout resistance factor of the polymer material having the at least one additive during a non-operational state of the cable apparatus; subjecting the polymer material having the at least one additive to an operational catalyst, wherein the operational catalyst includes at least one of: a temperature increase; and a pressure increase; and identifying a second pullout resistance factor of the polymer material having the at least one additive when it is subjected to the operational catalyst, wherein the second pullout resistance factor is substantially equivalent to the first pullout resistance factor.

* * * * *